US007174118B2

(12) United States Patent
Jeong et al.

(10) Patent No.: US 7,174,118 B2
(45) Date of Patent: Feb. 6, 2007

(54) SLUDGE PREVENTION APPARATUS OF TUBE MEMBER AND IMAGE FORMING APPARATUS HAVING THE SAME

(75) Inventors: Yoo-Hung Jeong, Anyang-si (KR); Jin-Geun Kwak, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 235 days.

(21) Appl. No.: 10/998,981

(22) Filed: Nov. 30, 2004

(65) Prior Publication Data

US 2005/0232660 A1 Oct. 20, 2005

(30) Foreign Application Priority Data

Apr. 16, 2004 (KR) ..... 10-2004-0026131

(51) Int. Cl.
*G03G 15/10* (2006.01)

(52) U.S. Cl. ..... 399/237; 399/107; 399/119; 399/120

(58) Field of Classification Search ..... 399/107, 399/119, 120, 222, 233, 237, 238
See application file for complete search history.

(56) References Cited

U.S. PATENT DOCUMENTS 5,344,573 A * 9/1994 Hill et al. ..... 210/768
5,359,398 A * 10/1994 Echigo et al. ..... 399/71
5,442,427 A * 8/1995 Day ..... 399/237
5,526,101 A 6/1996 Weed

FOREIGN PATENT DOCUMENTS

| | | |
|---|---|---|
| JP | P10-247009 | 9/1998 |
| JP | 2001-337523 | 12/2001 |
| KR | 2001-060335 | 11/2000 |

* cited by examiner

*Primary Examiner*—Hoan Tran
(74) *Attorney, Agent, or Firm*—Roylance, Abrams, Berdo & Goodman, L.L.P.

(57) ABSTRACT

Disclosed are a sludge prevention apparatus of a tube member and an image forming apparatus provided with such a sludge prevention apparatus. The sludge prevention apparatus comprises a sludge stirring member located in a tube member to be movable, so that the sludge stirring member stirs the developer sludge deposited or as being deposited in the tube member, the liquid developer being discharged from or flowing into a developer storage chamber through the tube member; and an operating member installed in the developer storage chamber to correspond to the sludge stirring member in such a manner that the operating member operates the sludge stirring member to stir the developer sludge. The sludge prevention apparatus and the image forming apparatus with the same can prevent the tube member from being blocked by the developer sludge deposited in the tube member. As a result, it is possible to substantially reduce poor feeding of developer caused by the blockage of the tube member and hence substantially reduce or eliminate poor printing and/or pollution of developer.

20 Claims, 7 Drawing Sheets

SLUDGE PREVENTION APPARATUS OF TUBE MEMBER AND IMAGE FORMING APPARATUS HAVING THE SAME

CROSS-REFERENCE TO RELATED APPLICATIONS

This application claims benefit under 35 U.S.C. §119(a) of an application entitled "Sludge Prevention Apparatus of Tube Member and Image Forming Apparatus Having the Same" filed in the Korean Intellectual Property Office on Apr. 16, 2004 and assigned Ser. No. 2004-26131, the entire contents of which are expressly incorporated herein by reference.

BACKGROUND OF THE INVENTION

1. Field of the Invention

The present invention generally relates to an image forming apparatus such as a wet electrophotographic printer using a liquid developer. More particularly, the present invention relates to a sludge prevention apparatus in an image forming apparatus for preventing developer sludge from being deposited in a tube member, through which the liquid developer is discharged from and/or flown into an ink cartridge and/or a developing apparatus at the time of developing, thereby preventing the tube member from being blocked.

2. Description of the Related Art

In general, developer feeding apparatuses for use in an image forming apparatus such as a wet electrophotographic printer are classified as either an integral type or a separate type. The integral type developer feeding apparatus is one in which a developer cartridge and a developing apparatus are integrally formed with each other. The separate type developer feeding apparatus is one in which a developer cartridge and a developing apparatus are separately formed and interconnected with each other through a connection tube.

A separate type developer feeding apparatus typically feeds liquid developer made from a mixture of powdered toner and volatile liquid carrier from a developer cartridge into a developing apparatus using a developer feeding pump at the time of developing. The developer is then retrieved from the developing apparatus to the developer cartridge using a developer retrieving pump.

Referring to FIG. 1, a conventional wet electrophotographic printer 10 is schematically shown, which employs a separate type developer feeding system.

The wet electrophotographic printer 10 includes an image forming unit 11 and a developer feeding unit 21.

The image forming unit 11 comprises a photoconductor 1, such as an OPC (Organic PhotoConductive) drum, a laser scanning unit 33, an electrifying section 6, an electric discharge section 7, a developing apparatus 26, and a cleaning blade 8. These components cooperate with each other to perform image forming procedures such as electrification, electric discharge, exposure, and development in sequence, to form a desired image on the photoconductor.

The developing apparatus 26 includes a developing chamber 27 for holding liquid developer 48, a developing roller 2 located under the photoconductor 1, and a deposit roller 5 for forming a layer of electrified developer on the developing roller 2 by applying electric force to the liquid developer 48. The developing apparatus 26 further includes a metering roller 3 for controlling the electrified developer layer formed on the developing roller 2 by the deposit roller 5 to contain a predetermined amount or content (% solid) of toner, and for also feeding the developer layer to the nip between the developing roller 2 and the photoconductor 1. A cleaning roller 4 for cleaning the developing roller 2, and a retrieving chamber 28 for holding or retaining the liquid developer 48 that overflows from the developing chamber 27 is also included in the developing apparatus 26.

In order to feed the liquid developer 48 to the developing chamber 27, there is provided a developer feeding unit 21 above the developing apparatus 26.

The developer feeding unit 21 includes a developer cartridge 15 that comprises a developer storage chamber with a first developer inlet section 16 and a first developer outlet section 17, and a developer feeding pump 18 located between a first and second connection tubes 22 and 23, and wherein the first connection tube 22 is connected to the first developer outlet section 17 of the developer cartridge 15 and wherein the second connection tube 23 is connected to a second developer inlet section 13 of the developing chamber 27 The developer feeding unit 21 further includes a developer retrieving pump 19 located between third and fourth connection tubes 24 and 20 and wherein the third connection tube 24 is connected to the first developer inlet section 16 of the developer cartridge 15 and a wherein the fourth connection tube 20 is connected to a second developer outlet section 14 of the developer retrieving chamber 28.

The developer feeding pump 18 and the developer retrieving pump 19 each include a DC motor (not shown), which is controlled to rotate at a predetermined velocity according first and second control signals PWM1 and PWM2 generated in a controller 29.

Because the conventional printer 10 configured as described above uses liquid developer comprised of powdered toner mixed with a volatile liquid carrier, the toner contained in the liquid developer 48 is deposited in the developer cartridge 15, the developing chamber 27 and the retrieving chamber 28 in the form of sludge if the printer is not used for sufficiently long periods of time.

In order to disperse such toner sludge, conventional printers are provided with stirrers 35 (as shown in FIG. 2) for stirring the toner sludge in the developer cartridge 15, the developing chamber 27 and the retrieving chamber 28 (FIG. 2 shows only the stirrer provided in the developer cartridge 15). There is a problem, however, in that such stirrers 35 cannot disperse the sludge that becomes accumulated in narrow gaps such as are present in the developer inlet tube 40 of the first developer outlet section 17 of the developer cartridge 15, the developer outlet port or tube 13' of the second developer inlet section 13 of the developing chamber 27, and the developer inlet port or tube 14' of the second developer outlet section 14 of the retrieving chamber 28. The stirrers 35 can readily stir and disperse the sludge accumulated on the bottoms of the developer cartridge 15, the developing chamber 27, and the retrieving chamber 28.

If the toner sludge becomes accumulated in the developer suction (inlet) tube 40 of the first developer outlet section 17 of the developer cartridge 15 without being dispersed, then the developer outlet port 13' of the second developer inlet section 13, the developer inlet port 14' of the second developer outlet section 14, the developer inlet tube 40, the developer outlet port 13', and the developer inlet port 14' can all become blocked. If the developer feeding pump 18 and the developer retrieving pump 19 operate under this condition, problems arise in that the liquid developer in the developer cartridge 15 is not properly fed to the developing chamber 27 or, conversely, the liquid developer 48 in the retrieving chamber 28 is not properly retrieved from the developer cartridge 15.

If the liquid developer 48 in the developer cartridge 15 is not properly and adequately fed to the developing chamber, the wet electrophotographic images may not be formed in the developing apparatus 26 due to the shortage of developer. In addition, if the liquid developer 48 in the retrieving chamber 27 is not properly or adequately retrieved from the developer cartridge 15, there will be a serious problem in that the liquid developer 48 overflows from the retrieving chamber 28 and contaminates the surroundings (such as the interior of the wet electrophotographic printer).

SUMMARY OF THE INVENTION

Accordingly, the present invention has been conceived to solve the above-mentioned problems occurring in the prior art, and an aspect of the present invention is to provide a sludge prevention apparatus for preventing developer sludge from being deposited in a tube member, through which the liquid developer is discharged from and/or flows into an ink cartridge, a developing chamber and/or a retrieving chamber of a developing apparatus at the time of developing, thereby preventing poor feeding of developer, poor printing and/or pollution of developer caused by the blockage of the tube member, and an image forming apparatus having such a sludge prevention apparatus.

In order to achieve the above mentioned and other objects, there is provided a sludge prevention apparatus of a tube member of an image forming apparatus comprising at least one tube member, through which liquid developer is discharged from or flown into a developer storage chamber; a sludge stirring member located in the tube member to be movable and stirring the developer sludge as the sludge is deposited in the tube member, and an operating member installed in the developer storage chamber to correspond to the sludge stirring member and operating the sludge stirring member in such a manner that the sludge stirring member stirs the developer sludge.

In an exemplary embodiment of the present invention, the sludge stirring member comprises a body installed rotatable on the tube member, and a sludge stirring section fixed to the body in such a manner that the sludge stirring section is located within the tube member, and stirs the developer sludge.

The body comprises a cylinder supported to be rotatable about the tube member and further comprises a core provided with at least one opening communicating with a space within the tube member, and the sludge stirring section comprises a spiral coil fixed to the core of the cylinder and extending within the tube member. In another embodiment of the present invention, the spiral coil is formed in such a manner that the diameter of the coil increases as it approaches the core of the cylinder.

According to an embodiment of the present invention, the operating member comprises a shaft rotated by a driving source, and at least one operating lobe formed on the shaft to be radially projected and being operated to rotate the body of the sludge stirring member as the shaft rotates.

According to another embodiment of the present invention, the shaft is a shaft of a stirrer for stirring the liquid developer within the developer storage chamber, and the operating lobe comprises at least one rod.

According to another embodiment of the present invention, the body of the sludge stirring member can further comprise a counterpart lobe formed around the body in such a manner that the counterpart lobe can be engaged with and operated by the operating lobe.

According to another embodiment of the present invention, the counterpart lobe can take the form of a fan so that it produces turbulent flow when the body is operated by the operation lobe.

In addition, according to an embodiment of the present invention, the sludge prevention apparatus can further comprise a support member for supporting the sludge stirring member so that the sludge stirring member is rotatable about the tube member. The support member comprises a circular projection formed one of the tube member and the sludge stirring member, and a circular receiving recess formed on the other of the tube member and the sludge stirring member to correspond to the circular projection, thereby receiving the circular projection. Alternatively, the support member can include a support shaft formed on the sludge stirring member and extending to the bottom of the developer storage chamber, so that the support shaft supports the sludge stirring member to be rotatable about the tube member.

According to another aspect of the present invention, there is provided a sludge prevention apparatus of a tube member of an image forming apparatus comprising at least one tube member, through which liquid developer is discharged from or flown into a developer storage chamber, a sludge stirring member located in the tube member to be movable and stirring the developer sludge as being deposited in the tube member and an operating member installed in the developer storage chamber to correspond to the sludge stirring member and operating the sludge stirring member in such a manner that the sludge stirring member stirs the developer sludge. The sludge prevention apparatus of a tube member of an image forming apparatus further comprises an elastic support member for elastically supporting the sludge stirring member so that the sludge stirring member is returned to its original position after it is operated by the operating member.

In another embodiment of the present invention, the sludge stirring member comprises a body installed on the tube member to be vertically movable, and a sludge stirring section for stirring the sludge, wherein the sludge stirring section is fixed to the body so that the sludge stirring section is located within the tube member. The body comprises a cylinder supported on the tube member to be vertically movable and having a core provided with at least one opening communicated with the space within the tube member, and the sludge stirring section comprises a spiral coil fixed to the core and extending within the tube member.

The operating member according to an embodiment of the present invention comprises a shaft rotated by a driving source, and at least one operating lobe formed on the shaft to be radially projected and being operated to vertically move the body of the sludge stirring member as the shaft rotates.

According to another embodiment of the present invention the shaft comprises a shaft of a stirrer for stirring the liquid developer within the developer storage chamber, and wherein the operating lobe comprises at least one curved projection. The body further comprises a circular rim formed around the body to be vertically moved by the curved projection. The elastic support member comprises an elastic spring located on a spring seat formed on the bottom of the developer storage chamber to elastically support the sludge stirring member in such a manner that the cylinder of the body of the sludge stirring member can vertically move.

According to another aspect of the present invention, there is provided an image forming apparatus comprising a developer cartridge for containing liquid developer, a developing apparatus having a developing chamber connected to the developer cartridge and reserving the liquid developer fed from the developer cartridge, and a retrieving chamber connected to the developer cartridge and retrieving the liquid developer overflowed from the developing chamber, and at least one tube member located in at least one of the developer cartridge, the developing chamber and the retrieving chamber, through which the liquid developer is discharged and flown into the at least one component in which the at least one tube member is located. The image forming apparatus further comprises a sludge prevention apparatus for preventing the developer sludge from being deposited in the tube member, wherein the sludge prevention apparatus comprises a sludge stirring member located in the tube member to be movable and stirs the developer sludge as it is being deposited into the tube member, and an operating member installed in the developer storage chamber to correspond to the sludge stirring member in such a manner that the operating member operates the sludge stirring member to stir the developer sludge.

According to another embodiment of the present invention, the image forming apparatus further comprises an elastic support member for elastically supporting the sludge stirring member so that the sludge stirring member is returned to its original position after it is operated by the operating member.

BRIEF DESCRIPTION OF THE DRAWINGS

The above and other objects, features and advantages of the present invention will be more apparent from the following detailed description taken with reference to the accompanying drawings, in which.

DETAILED DESCRIPTION OF THE EXEMPLARY EMBODMIMENTS

Figure 1:
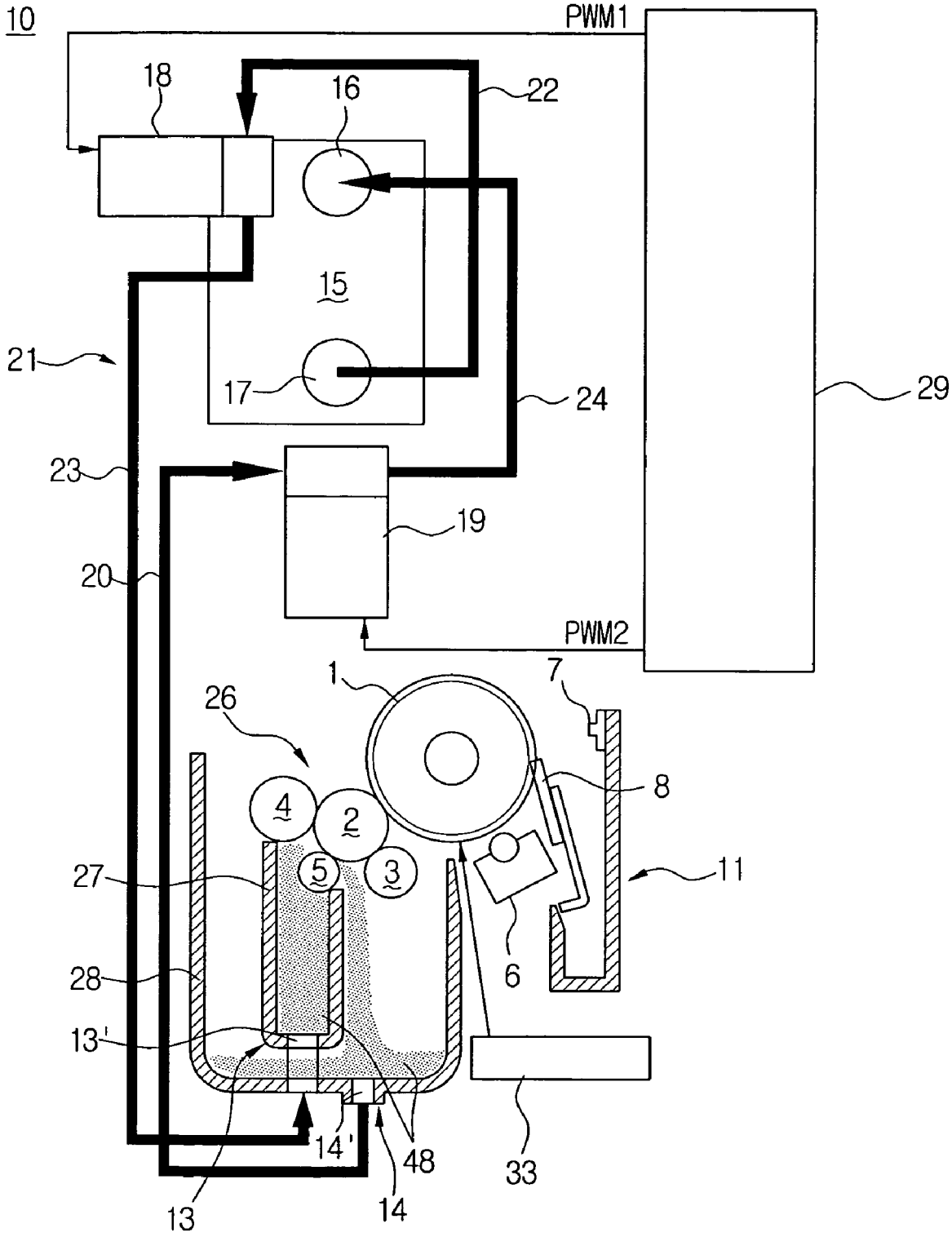
FIG. 1 (PRIOR ART)
FIG. 1 is a schematic view of a conventional wet electrophotographic printer.
Figure 2:
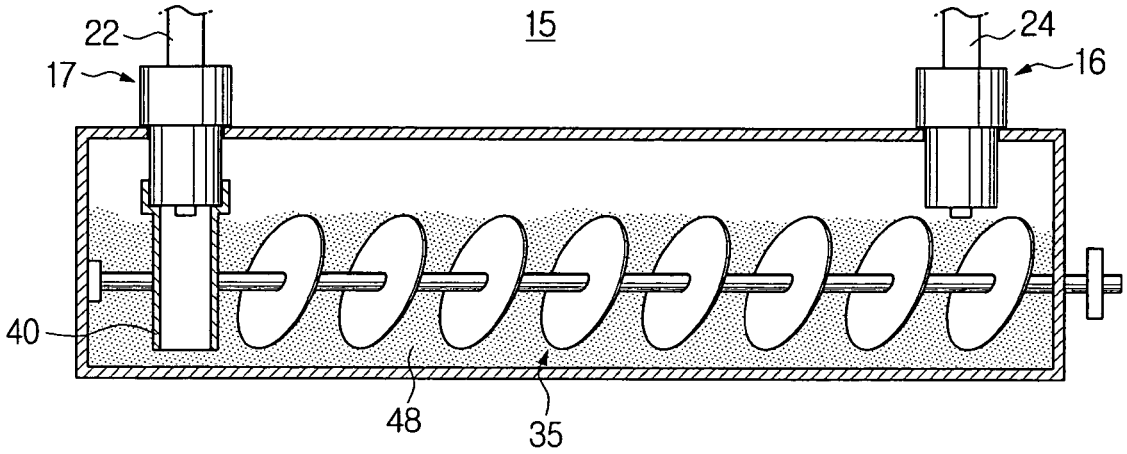
FIG. 2 (PRIOR ART)
FIG. 2 is a cross-sectional view of the developer cartridge of the wet electrophotographic printer shown in FIG. 1.

Hereinbelow, exemplary embodiments of the present invention will be described in detail with reference to the accompanying drawings. In the drawings, the same or similar elements are denoted by the same reference numerals even though they are depicted in different drawings. In the following description, a detailed description of known functions and configurations incorporated herein have been omitted for conciseness.

Figure 3:
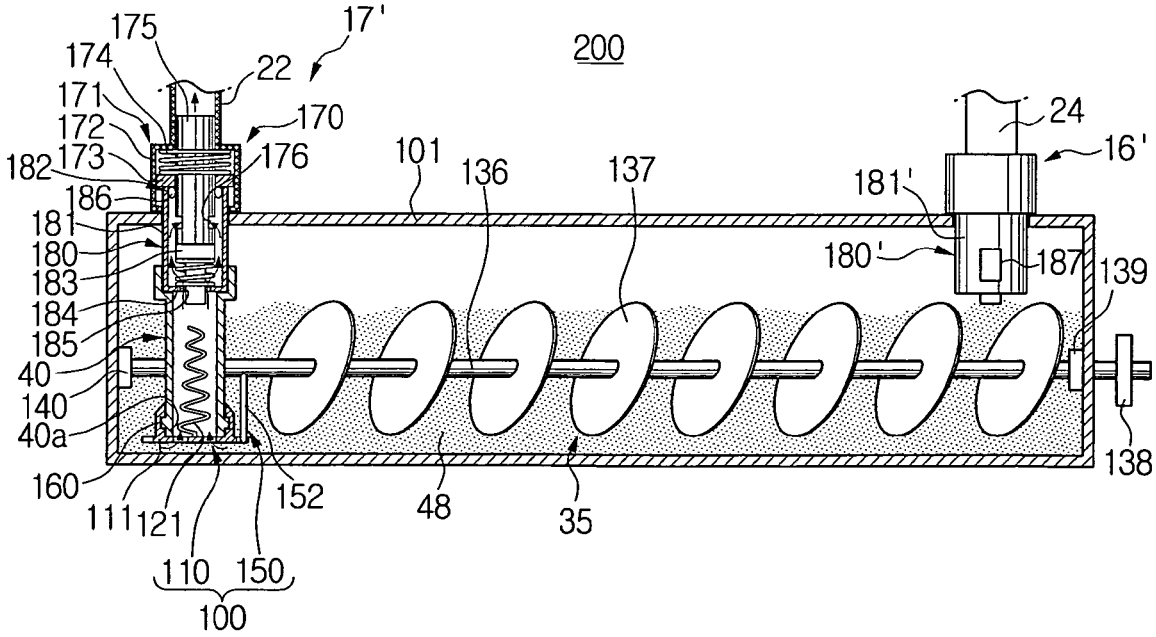
FIG. 3 is a cross-sectional view of a developer cartridge of a wet electrophotographic printer, to which a sludge prevention apparatus for a tube member is applied according to an embodiment of the present invention.

FIG. 3 illustrates a developer cartridge 200 of an image forming apparatus such as a wet electrophotographic printer, to which a sludge prevention apparatus 100 of a tube member according to an embodiment of the present invention is applied. The image forming apparatus incorporating the developer cartridge 200 is substantially the same as the wet electrophotographic printer 10 shown and described with reference to FIG. 1, except the developer cartridge 200.

The developer cartridge 200 includes a housing 101 for defining a developer storage space for storing liquid developer 48, a stirrer 35 for stirring the liquid developer within the housing 101, and a first developer outlet section 17' connected to a second developer inlet section 13 of the developing chamber 27 of the developing apparatus 26 through the first connection tube 22, then the developer feeding pump 18 and then through the second connection tubes 23 to discharge the liquid developer 48 within the housing 101 to a the developing chamber 27. The developer cartridge 200 further includes first developer inlet section 16' connected to a second developer outlet section 14 of the retrieving chamber 28 of the developing apparatus 26 through the fourth connection tube 20, through the developer retrieving pump 19 and then through the third connection tubes 24, to retrieve the developer 48 from the retrieving chamber 28. The developer cartridge 200 further includes a sludge prevention apparatus 100 of a tube member located in the first developer outlet section 17' to prevent the developer sludge from being deposited in an developer inlet tube (tube member) 40 defining a developer inlet port.

The housing 101 is formed in a shape of a rectangular box. The stirrer 35 includes a shaft 136 supported by supporting brackets 139 and 140 of the housing 101 at the opposite ends thereof, and a plurality of stirring fans 137 provided on the shaft 135 spaced by a predetermined distance from each other. The shaft is provided with a driving gear 138 connected to a driving motor (not shown) for driving the developing apparatus 26 through a gear train (not shown) at one end of the shaft.

The first developer outlet section 17' includes a fitting 170 mounted on the top of the housing 101 and connected to the first connection tube 22, and a developer inlet tube 40 extending from the lower part of the fitting 170 to the bottom of the housing 101.

The fitting 170 includes a female part 180 with a female fitting tube 181 fixed to the housing 101 at the upper part and connected with the developer inlet tube 40 at the lower part, and a male part 171 with a male fitting tube 172 connected with the first connection tube 22 at the upper part and threaded with the female fitting tube 181 at the lower part.

A T-shaped valve plate 183 is positioned within the female fitting tube 181 of the female part 180. The valve plate 183 of the female part 180 is elastically compressed by a first elastic spring 184 in such a manner that the valve plate 183 seals a top opening 182 in cooperation with a packing member 186 located in the top opening 182. The liquid developer 48 cannot, therefore, escape from the developer inlet tube 40 through the top opening 182 of the female fitting tube 181 when the male part 171 is separated from the female part 180. An inner communicating tube 175 of the male part 171, described in greater detail below, is removed from the top opening 182 of the female fitting tube 181.

A second packing member 173 and an inner communicating tube 175 are positioned within the male fitting tube 172 of the male part 171. The second packing member 173 is elastically compressed by a second elastic spring 174 in such a manner that the second packing member 173 seals a liquid developer inlet port 176 of the inner communicating tube 175 around the inner communicating tube 175, so that the liquid developer 48 cannot escape from the first connection tube 22 through the liquid developer inlet port 176 when the male part 171 is separated from the female part 180. The inner communicating tube 175 is connected to the first connection tube 22 at its upper part, and defines the liquid developer inlet port 176 for inhaling the liquid developer 48 flowing in through a lower opening 185 of the female fitting tube 180 at its lower part.

Therefore, when the female part 180 and the male part 171 of the fitting 170 are engaged with each other, the liquid developer 48 can be fed to the first connection tube 22 from the developer inlet tube 40 in the housing 101 through the lower opening 185 of the female fitting tube 181 and the liquid developer inlet port 176 of the inner communicating tube 175.

The first developer inlet section 16' has the same construction with that of the first developer outlet section 17' except that the female fitting tube 181' of the female part 180' is additionally formed with a liquid developer outlet 187.

The sludge prevention apparatus 100 of a tube member according to an embodiment of the present invention includes a sludge stirring member 110 rotatably located at an end 40*a* of the developer inlet tube 40 of the first developer outlet section 17' to stir the developer sludge deposited in the developer inlet tube 40. The sludge prevention apparatus 100 of a tube member according to an embodiment of the present invention further includes an operating member 150 installed to correspond to the sludge stirring member 110 and operate the sludge stirring member 110 in such a manner that the sludge stirring member stirs the developer sludge.

Figure 4:
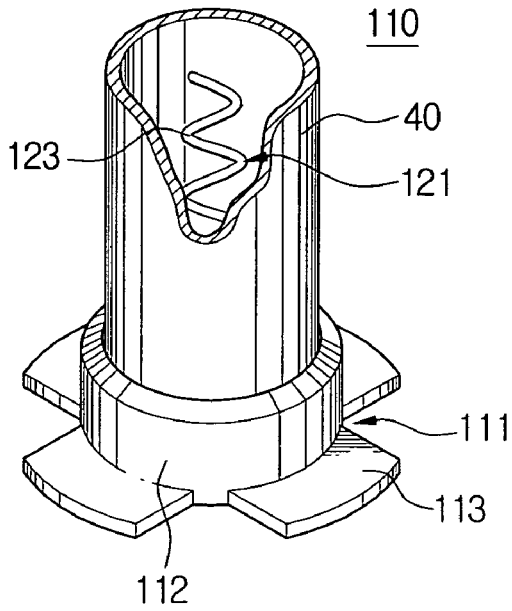
FIG. 4 is a perspective view of the sludge stirring member of the sludge prevention apparatus shown in FIG. 3.
Figure 5:
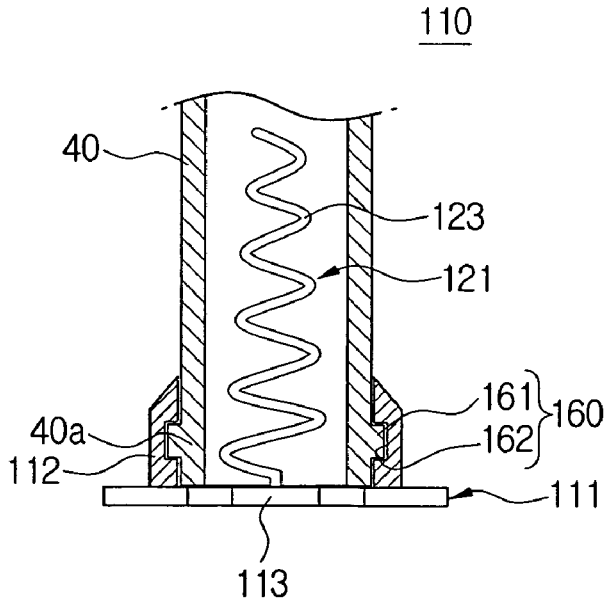
FIG. 5 is a cross-sectional view of the sludge stirring member shown in FIG. 4.

As shown in FIGS. 4 and 5, the sludge stirring member 110 includes a body 111 rotatably located at the end 40*a* of the developer inlet tube 40. The sludge stirring member 110 further includes a sludge stirring part 121 fixed on the body 111 within the space of the developer inlet tube 40 along the center of the developer inlet tube 40 and stirring the developer sludge.

Figure 6:
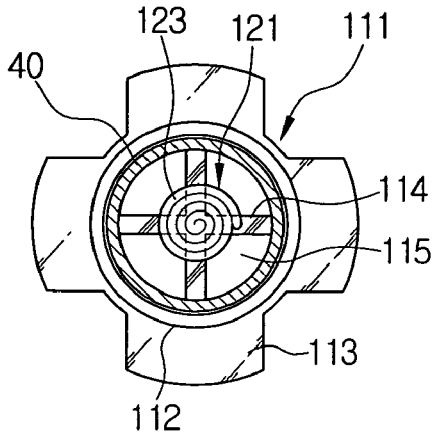
FIG. 6 is a top plan view of the sludge stirring member shown in FIG. 4.

The body 111 includes a ring-shaped cylinder 112 rotatably supported around the outer surface of the end 40*a* of the developer inlet tube 40. As shown in FIG. 6, the ring-shaped cylinder 112 includes a cross shape core 114 defining four openings 115 at the lower part thereof, which communicate with the space within the developer inlet tube 40, and four counterpart lobes or projections 113 formed around the cylinder 112 with a predetermined space, so that the projections 113 are engaged with and rotated by an operating lobe 152 of the operating member 150.

According to an embodiment of the present invention, each of the counterpart projections 113 is preferable formed in a fan shape, so that the projections 113 produce turbulent flow as being rotated by the operating lobe 152. The sludge stirring part 121 includes a spiral coil 123 fixed at the center of the top of the core 114 and extending along the center of the space within the developer inlet tube 40. The spiral coil 123 serves to drill and stir the developer sludge within the developer inlet tube 40 as it is being rotated. According to an embodiment of the present invention, the diameter of the spiral coil 123 increases as is approaches the core 114 of the cylinder 112.

Referring to FIG. 3 again, the operating member 150 includes a shaft 136 of the stirrer 35 connected to a driving motor for driving the developing apparatus through a gear train, and the operating lobe 152 radially projects from the shaft 136 of the stirrer 35 toward the counterpart projections 113. The operating lobe 152 operates to rotate the counterpart projections 113 of the cylinder 112 as the shaft 136 rotates. The operating lobe 152 is formed by a single rod. According to another embodiment of the present invention, the operating lobe 152 can include a plurality of rods or lobes instead of a single rod.

The sludge prevention apparatus 100 according to an embodiment of the present invention further includes a support member 160 for rotatably supporting the cylinder 112 against the outer surface of the end 40*a* of the developer inlet tube 40 when the counterpart projections 113 of the cylinder 112 of the sludge stirring member 110 is rotated by the operating lobe 152 of the operating member 150.

Figure 7:
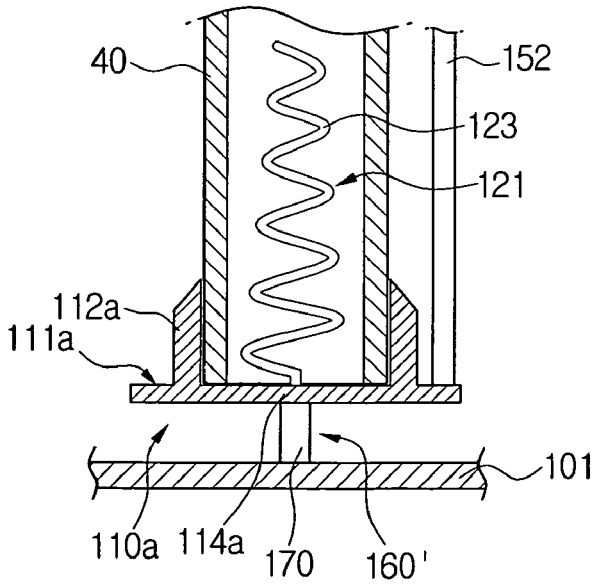
FIG. 7 is a partial section view of a variant embodiment of the sludge stirring member of the sludge prevention apparatus according to the first embodiment of the present invention shown in FIG. 3.

As shown in FIG. 5, the support member 160 includes a circular projection 161 formed around the outer surface of the end 40*a* of the developer inlet tube 40, and a circular receiving groove 162 formed on the inner surface of the cylinder 112 to be capable of receiving the circular projection 161. According to another embodiment of the present invention, as shown in FIG. 7, the support member 160' can include a support shaft 170 extending from the center of the lower side surface of the core 114*a* of the cylinder 112*a* to the bottom of the housing 101, instead of including the circular projection 161 and the circular receiving groove 162.

Although it has been exemplified and described above that the sludge prevention apparatus 100 according to the first embodiment of the present invention is installed only in relation to the developer tube 40 of the first developer outlet section 17' of the developer cartridge 200, the embodiments of the present invention are not limited to this particular arrangement. With the same principle, such a sludge prevention apparatus can be installed within the developer outlet port 13' of the second developer inlet section 13 of the developing chamber 27 and/or the second developer inlet port 14' of the second developer outlet section 14 of the retrieving chamber 28.

Operation of the developer cartridge 200 of the wet electrophotographic printer that includes the sludge prevention apparatus 100 configured according to the first embodiment of the present invention as described above, is described in detail with reference to FIGS. 3 to 6. Initially, when the stirrer 35 is driven by the driving motor for driving the developing apparatus 26, the shaft 136 of the stirrer 35 is rotated by a driving gear 138 connected to the driving motor through the gear train, so that the developer 48 is stirred by the stirring fans 137.

As the shaft 136 rotates, the operating lobes 152 formed on the shaft 136 are engaged with and rotate the counterpart projections 113 of the cylinder 112, as a result of which the cylinder 112 rotates in relation to the end 40*a* of the developer inlet tube 40. At this time, the counterpart projections 113 of the cylinder 112 of which each is formed in the shape of a fan, stir the liquid developer 48 around them while rotating, and the spiral coil 123 of the sludge stirring part 121, which is fixed to the center of the top surface of the core 114, rotates, and hence drills and stirs the developer sludge within the developer inlet tube 40.

Therefore, if the developer cartridge 200 is left for a long period of time without being used, the developer sludge deposited in the developer inlet tube 40 can be drilled, stirred and then removed at the time of operating the stirrer 35, whereby the inadequate feeding of developer caused by blockage of the developer inlet tube 40. Since the supply of developer is substantially improved, poor printing caused by an inadequate supply of developed (due to blockages) can be substantially prevented.

Figure 8:
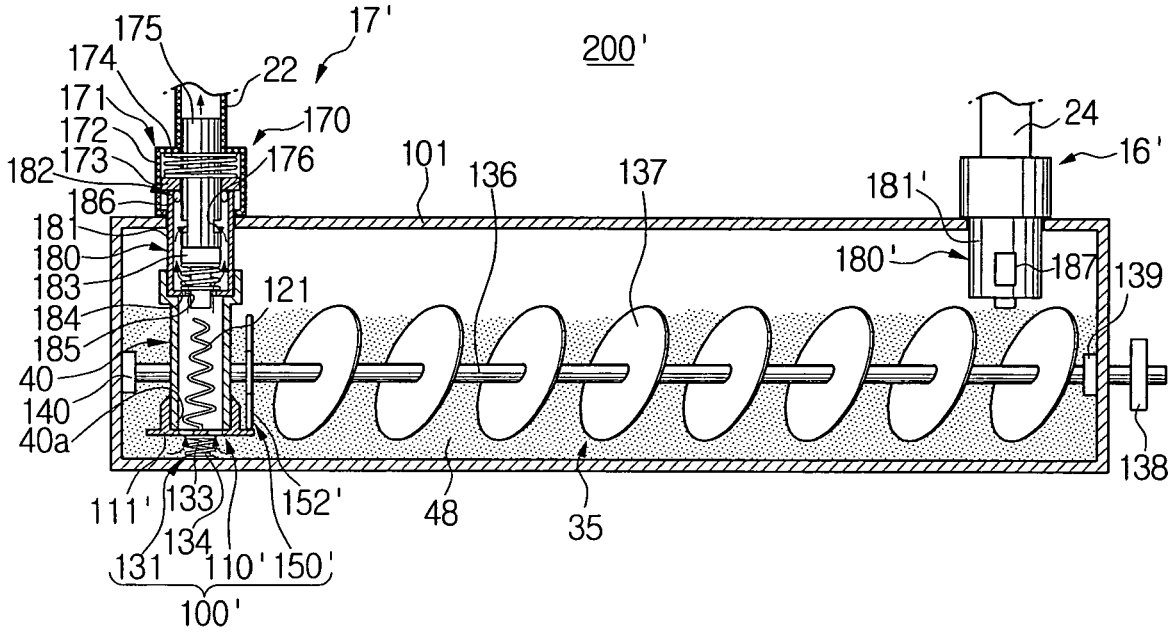
FIG. 8 is a cross-sectional view of a developer cartridge of a wet electrophotographic printer, to which a sludge prevention apparatus for a tube member according to another embodiment of the present invention is applied.

FIG. 8 illustrates a developer cartridge 200' of an image forming apparatus such as a wet electrophotographic printer that comprises a sludge prevention apparatus 100' of a tube member according to a second embodiment of the present invention. The image forming apparatus that comprises the developer cartridge 200', is identical to the wet electrophotographic printer 10 described above with reference to FIG. 1, and the developer cartridge 200' is identical to the developer cartridge 200 described above with reference to FIGS. 3 to 7, except in regard to the sludge prevention apparatus 100'.

The sludge prevention apparatus 100' of the second embodiment of the present invention comprises a sludge stirring member 110' stirring the developer sludge deposited in the developer inlet tube 40. The sludge stirring member 110' is located in a developer inlet tube 40 of a first developer outlet section 17' to be vertically movable. The sludge prevention apparatus 100' further comprises an operating member 150' located to correspond to the sludge stirring member 110' in such a manner that the operating member 150' operates the sludge stirring member 110' to stir the developer sludge, and an elastic support member 131 for elastically supporting the sludge stirring member 110' in such a manner that the sludge stirring member 110' is returned to its original position after it is operated by the operating member 150'.

Figure 9:
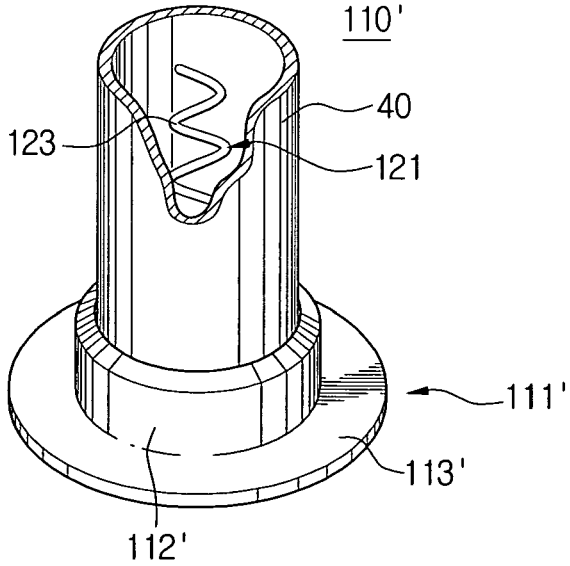
FIG. 9 is a perspective view of the sludge stirring member of the sludge prevention apparatus shown in FIG. 8.
Figure 10:
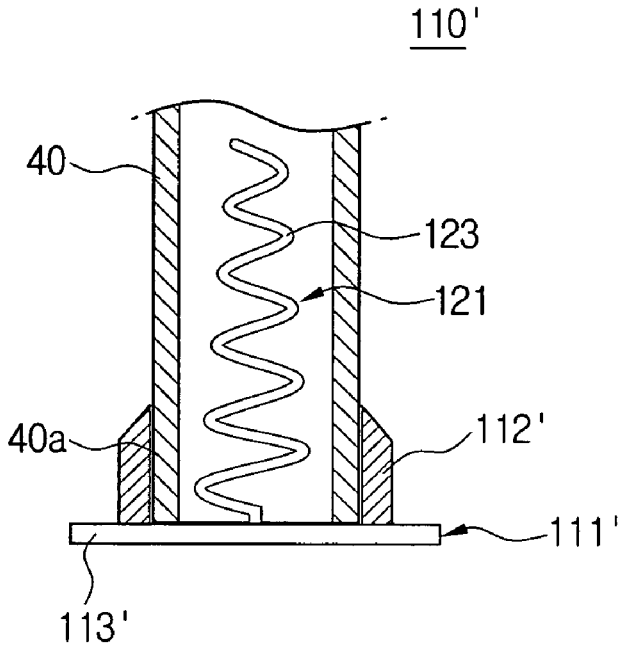
FIG. 10 is a cross-sectional view of the sludge stirring member shown in FIG. 9.
Figure 11:
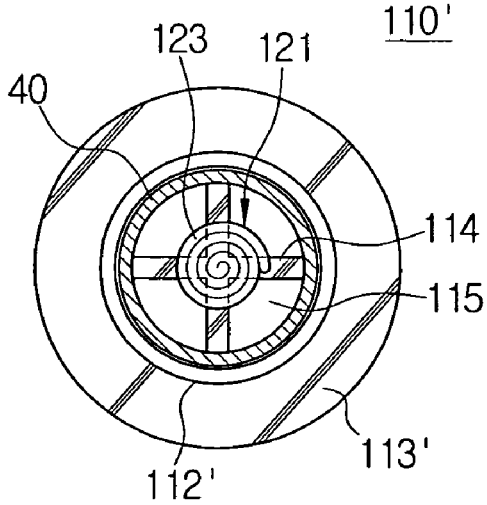
FIG. 11 is a top plan view of the sludge stirring member shown in FIG. 9.

As shown in FIGS. 9, 10 and 11, the sludge stirring member 110' includes a body formed by a ring-shaped cylinder 112' supported about the outer surface of the end of the developer inlet tube 40 to be vertically movable. The sludge stirring member 110' further includes a sludge stirring section 121 formed by a spiral coil 123 fixed to a core 114 in the cylinder 112' that extends along the center of the space within the developer inlet tube 40.

The ring-shaped cylinder 112' includes a cross shape core 114 defining four openings 115 at the lower part of the cylinder, which communicate with the space within the developer inlet tube 40. A circular rim 113' is formed around the cylinder 112', so that the circular rim 113' is vertically movable by curved projections 156 of the operating lobe 152' (to be described in greater detail below), when the curved projections 156 of the operating lobe 152' rotate.

Figure 12:
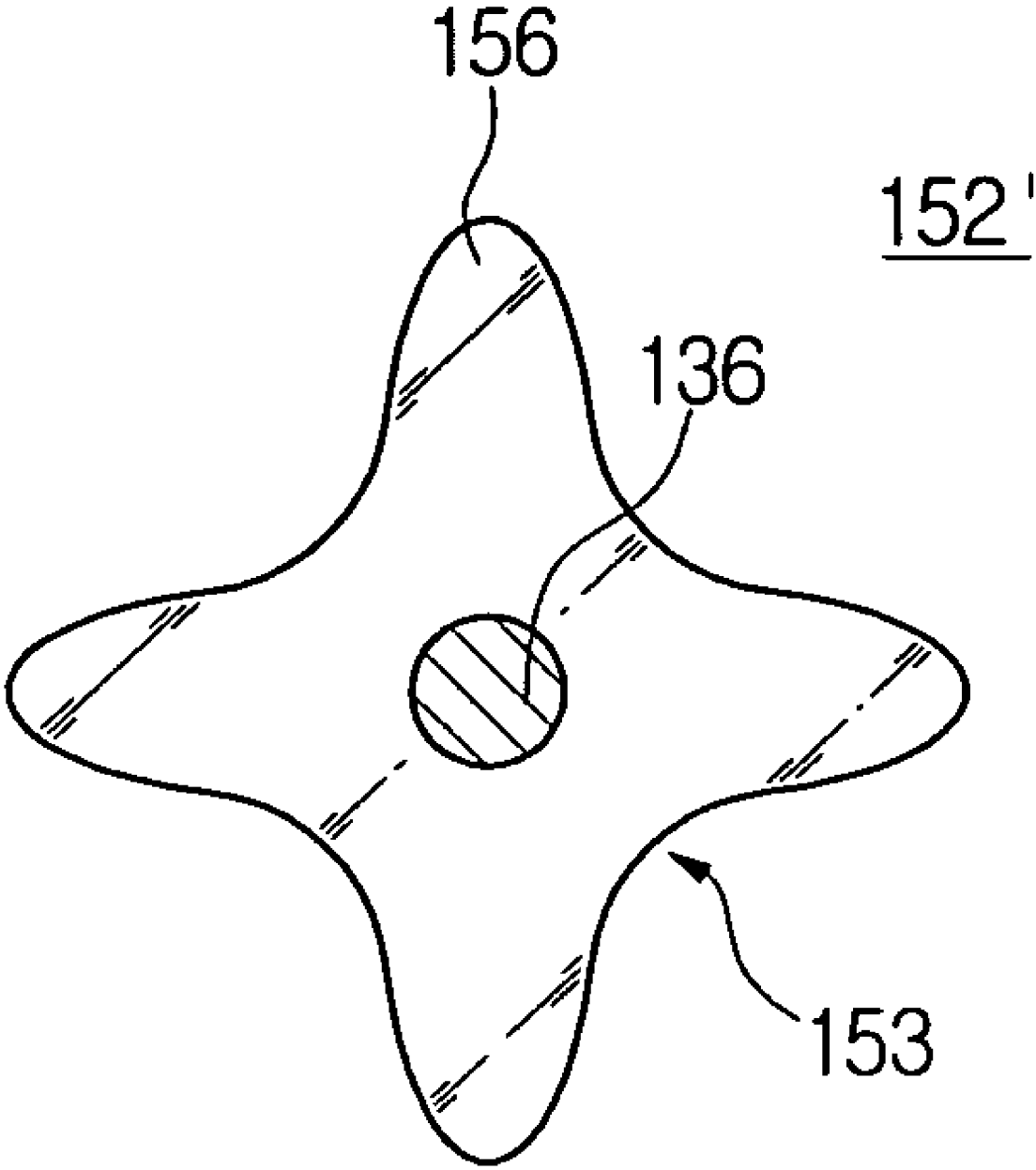
FIG. 12 is a side elevation view of an operating member of the sludge prevention apparatus shown in FIG. 8.

The operating member 150' includes a shaft 136 of the stirrer 35 connected to a driving motor for driving the developing apparatus 26 through a gear train, and the operating lobe 152' is operated to vertically move the cylinder 112' by downwardly compressing the circular rim 113' of the cylinder 112' as the shaft rotates. As shown in FIG. 12, the operating lobe 152' is formed in a cross shape member 153 formed with four curved projections 156, wherein the curved projections 156 are radially projected toward the circular rim 113' of the cylinder 112' of the body 111' on the shaft 136 of the stirrer 35.

Although it has been shown and described herein that the operating lobe 152' is formed in a cross shape member 153 with four curved projections 156, the operating lobe 152' can be formed in many different shapes, such as a star-shape or triangular member. In exemplary embodiments of the present invention, the operating lobes 152' of different shapes will each have four lobes, but other alternative embodiments are possible with different number of operating lobes 152'.

In addition, although it has been exemplified and described that the operating lobe 152' includes a single cross shape member 153 formed on the shaft 136 to face a side of the edge of the circular rim 113' of the cylinder 112', the operating lobe 152' can be formed by two cross shape members (not shown) formed on the shaft 136 to face the opposite sides of the edge of the circular rim 113', so that the cylinder 112' can be vertically moved in a smooth manner.

Returning to FIG. 8, the elastic support member 131 includes a compression spring 133 located on a spring seat 134 formed on the bottom of the housing 101 that elastically supports the body 111' of the sludge stirring member 110' to be vertically movable. Operation of the developer cartridge 200' of the wet electrophotographic printer that includes the sludge prevention apparatus 100' of a tube member according to the second embodiment of the present invention, is described below with reference to FIGS. 8 to 12.

Initially, when the shaft 136 of the stirrer 35 is rotated by the driving gear 138 connected to the driving motor 138 through the gear train, the stirrer 35 stirs liquid developer 48 by way of the stirring fans 137. At the same time, the operating lobe 152 formed on the shaft 136 also rotates. As the operating lobe 152' rotates, the curved projections 156 repeatedly compresses the circular rim 113' of the cylinder 112' downwardly against the compression spring 134, so that the cylinder 112' is downwardly moved by the curved projections 156 and then upwardly returned by the compression spring 134. These movements are repeatedly performed as the shaft 136 of the stirrer 35 is rotated by the driving gear 138 connected to the driving motor 138 through the gear train.

As a result, the circular rim 113' of the cylinder 112' stirs the surrounding liquid developer 48 while moving up and down, and the spiral coil 123 of the sludge stirring section 121 that is fixed to the center of the top of the core 114 of the cylinder 112' moves up and down, thereby stirring the developer sludge within the developer inlet tube 40 concurrently with drilling the sludge. As described above, it can be appreciated that the inventive sludge prevention apparatus of a tube member prevents the blockage of sludge. Furthermore, an image forming apparatus provided with such a sludge prevention apparatus can prevent a tube member, such as a developer inlet tube, which defines a developer outlet section and/or a developer inlet section, through which liquid developer flows into and is discharged from a developing chamber and/or a retrieving chamber of a developing apparatus, is kept from being blocked by the developer sludge deposited in such a tube member. Blockages of the aforementioned tube members can cause poor feeding of developer, poor printing and/or pollution of the developer in the printer. These blockages are substantially reduced and therefore the quality and reliability of the printer increase substantially.

While the exemplary embodiments of the present invention have been shown and described with reference to the representative embodiments thereof in order to exemplify the principle of the present invention, the present invention is not limited to the embodiments. It will be understood that various modifications and changes can be made by those skilled in the art without departing from the spirit and scope of the invention as defined by the appended claims. Therefore, it shall be considered that such modifications, changes and equivalents thereof are all included within the scope of the present invention.

What is claimed is:

1. A sludge prevention apparatus of a tube member of an image forming apparatus comprising:

at least one tube member, through which liquid developer is discharged from, or flows into, a developer storage chamber;

a sludge stirring member located in the tube member to stir the developer sludge in the tube member; and an operating member installed in the developer storage chamber to correspond to the sludge stirring member and operating the sludge stirring member in such a manner that the sludge stirring member stirs the developer sludge.

2. The sludge prevention apparatus according to claim 1, wherein the sludge stirring member comprises:

a body installed rotatable on the tube member; and a sludge stirring section fixed to the body in such a manner that the sludge stirring section is located within the tube member, and stirs the developer sludge.

3. The sludge prevention apparatus as claimed in claim 2, wherein the body comprises:

a cylinder supported to be rotatable about the tube member and comprising a core provided with at least one opening communicating with a space within the tube member, and the sludge stirring section comprises a spiral coil fixed to the core of the cylinder and extending within the tube member.

4. The sludge prevention apparatus as claimed in claim 3, wherein the spiral coil is formed in such a manner that the diameter of the coil increases as it approaches the core of the cylinder.

5. The sludge prevention apparatus as claimed in claim 2, wherein the operating member comprises:

a shaft rotated by a driving source; and at least one operating lobe formed on the shaft to be radially projected and being operated to rotate the body of the sludge stirring member as the shaft rotates.

6. The sludge prevention apparatus as claimed in claim 5, further comprising:

the shaft is a shaft of a stirrer for stirring the liquid developer within the developer storage chamber; and the operating lobe comprises at least one rod.

7. The sludge prevention apparatus as claimed in claim 5, wherein the body of the sludge stirring member further comprises:

a counterpart lobe formed around the body in such a manner that the counterpart lobe can be engaged with and operated by the operating lobe.

8. The sludge prevention apparatus as claimed in claim 7, wherein the counterpart lobe takes a form of fan so that it produces turbulent flow when the body is operated by the operation lobe.

9. The sludge prevention apparatus as claimed in claim 2, further comprising:

a support member for supporting the sludge stirring member so that the sludge stirring member is rotatable about the tube member.

10. The sludge prevention apparatus as claimed in claim 9, wherein the support member comprises:

a circular projection formed one of the tube member and the sludge stirring member; and a circular receiving recess formed on the other of the tube member and the sludge stirring member to correspond to the circular projection, thereby receiving the circular projection.

11. The sludge prevention apparatus as claimed in claim 9, wherein the support member comprises:

a support shaft formed on the sludge stirring member and extending to the bottom of the developer storage chamber, so that the support shaft supports the sludge stirring member to be rotatable about the tube member.

12. The sludge prevention apparatus as claimed in claim 1, further comprising:

an elastic support member for elastically supporting the sludge stirring member so that the sludge stirring member is returned to its original position after the sludge stirring member is operated by the operating member.

13. The sludge prevention apparatus as claimed in claim 12, wherein the sludge stirring member comprises:

a body installed on the tube member to be vertically movable; and a sludge stirring section for stirring the sludge, the sludge stirring section being fixed to the body so that the sludge stirring section is located within the tube member.

14. The sludge prevention apparatus as claimed in claim 13, wherein the body comprises:

a cylinder supported on the tube member to be vertically movable and having a core provided with at least one opening communicated with the space within the tube member, and the sludge stirring section comprises a spiral coil fixed to the core and extending within the tube member.

15. The sludge prevention apparatus as claimed in claim 13, wherein the operating member comprises:

a shaft rotated by a driving source; and at least one operating lobe formed on the shaft to be radially projected and being operated to vertically move the body of the sludge stirring member as the shaft rotates.

16. The sludge prevention apparatus as claimed in claim 15, wherein the shaft further comprises:

a shaft of a stirrer for stirring the liquid developer within the developer storage chamber; and the operating lobe comprises at least one curved projection.

17. The sludge prevention apparatus as claimed in claim 16, wherein the body further comprises:

a circular rim formed around the body to be vertically moved by the curved projection.

18. The sludge prevention apparatus as claimed in claim 12, wherein the elastic support member comprises:

an elastic spring located on a spring seat formed on the bottom of the developer storage chamber to elastically support the sludge stirring member in such a manner that the sludge stirring member can vertically move.

19. An image forming apparatus comprising:

a developer cartridge for containing liquid developer;

a developing apparatus having a developing chamber connected to the developer cartridge and for storing liquid developer fed from the developer cartridge, and a retrieving chamber connected to the developer cartridge for retrieving the liquid developer overflowed from the developing chamber;

at least one tube member located in at least one of the developer cartridge, the developing chamber and the retrieving chamber, through which the liquid developer is discharged and flows into the at least one developer cartridge, developing chamber or retrieving chamber in which the at least one tube member is located; and a sludge prevention apparatus for preventing the developer sludge from being deposited in the tube member, wherein the sludge prevention apparatus comprises a sludge stirring member located in the tube member to stir the developer sludge in the tube member; and an operating member installed in the developer storage chamber to correspond to the sludge stirring member in such a manner that the operating member operates the sludge stirring member to stir the developer sludge.

20. The image forming apparatus as claimed in claim 19, further comprising:

an elastic support member for elastically supporting the sludge stirring member so that the sludge stirring member is returned to its original position after it is operated by the operating member.

* * * * *